US006023213A

United States Patent [19]

Van Zeeland

[11] Patent Number: 6,023,213

[45] Date of Patent: Feb. 8, 2000

[54] RELOCATABLE KNOB RETENTION FOR MAGNETICALLY ACTUATED SWITCH

[75] Inventor: Anthony J. Van Zeeland, Mesa, Ariz.

[73] Assignee: DuraSwitch Industries, Inc., Mesa, Ariz.

[21] Appl. No.: 09/372,370

[22] Filed: Aug. 11, 1999

[51] Int. Cl.[7] ..... H01H 9/00

[52] U.S. Cl. ..... 335/205; 206/207; 200/43.04

[58] Field of Search ..... 335/205–207; 200/336, 43.04, 43.08

[56] References Cited

U.S. PATENT DOCUMENTS 5,523,730 6/1996 Van Zeeland ..... 335/205

5,867,082 2/1999 Van Zeeland ..... 335/205

*Primary Examiner*—Lincoln Donovan

*Assistant Examiner*—Raymond Barrera

*Attorney, Agent, or Firm*—Dorn, McEachran, Jambor & Keating

[57] ABSTRACT

A magnetically actuated switch has a carrier sheet with electrodes on one side thereof and an actuator knob on the other side. Magnets carried by the knob drag an armature around on the electrodes. A retainer for the knob permits physical or logical relocation of the knob with respect to the carrier sheet.

7 Claims, 7 Drawing Sheets

RELOCATABLE KNOB RETENTION FOR MAGNETICALLY ACTUATED SWITCH

BACKGROUND OF THE INVENTION

The present invention concerns electrical switches of the type having a movable magnet which acts on a conductive armature to move the armature relative to one or more sets of electrodes. The armature may move into and out of shorting relation with spaced electrodes. Or the electrodes may form a potentiometer or some other arrangement providing a desired logic or output. Examples of this type of switch are found in U.S. Pat. No. 5,867,082, the disclosure of which is incorporated herein by reference.

The switches have a carrier sheet on which the electrodes are formed by screen printing, etching or other suitable process. The carrier sheet can be made of a variety of materials depending on the application. Polyester film, circuit boards and dielectric-coated thin steel sheets are possibilities. Rotary and slide switches typically include a knob mounted on the carrier sheet for rotary, linear or complex motion. The knob carries a magnet for movement therewith adjacent the external surface of the carrier. Electrodes are formed on the opposite side of the carrier. An armature is made of electrically conductive and magnetic material. By magnetic material it is meant that the material is affected by a magnet. The magnet holds the armature up against the underside of the carrier and, accordingly, against the electrodes. Movement of the knob drags the armature around on the electrodes. In the case of on-off switches, the magnet moves the armature into and out of shorting relation with the switch contacts. The armature can be a flat, disc-shaped element. Alternately, it can be two or more spherical balls. Further alternate armature configurations include a flipper having two or more stable positions wherein different sets of contacts are shorted. A detent gear can be used to provide tactile feedback of movement into and out of switch closure. Preferably some sort of substrate, ball retainer or blister pack is used to protect and seal the electrodes and armature. There may be a spacer with an opening in which the armature is disposed and which permits movement of the armature.

SUMMARY OF THE INVENTION

The present invention concerns retainers for the actuating knob of a magnetically-actuated switch. One form of the retainer permits either physical or logical relocation of the actuating knob. The switch has a carrier sheet with electrodes on one side and an armature adjacent the electrodes. The other side of the carrier sheet has a knob, mounted for rotational, linear or complex movement relative to the electrodes. The knob carries one or more magnets such that movement of the knob causes corresponding movement of the armature. The actuating knob is held on the carrier sheet by a retainer such that the knob can be relocated relative to the electrodes. This is done either by physically removing the entire knob and magnets from the carrier sheet or logically by relocating the magnets within a knob.

In one embodiment the retainer is a sheet metal cover overlying the carrier sheet and having an opening therein for receiving the knob. A hub portion of the knob protrudes through the opening such that it is manipulable by a user. A flange portion of the knob remains captured under the cover to hold the knob on the carrier. A retainer magnet may be attached to the underside of the carrier for holding the cover in place. The retainer magnet can be extended to operate a pushbutton type switch also.

A second embodiment of the retainer is adhesively secured to the carrier sheet. The retainer has flexible tabs which are engageable with grooves formed in the edges of the knob. The tabs are slidable within the grooves to allow actuating movement of the knob. Application of sufficient force will cause the tabs to release from the grooves, allowing the knob to be removed from the carrier sheet. In both embodiments a containment member is provided on the underside of the carrier sheet to keep the armature in the vicinity of the carrier sheet.

A variation on this arrangement provides a magnet retractor that can pull the magnets out of a first receptacle in the knob, move them to another location on the knob and reinsert them in a second receptacle. This provides a logical relocation of the knob instead of a physical one.

DETAILED DESCRIPTION OF THE INVENTION

Figure 1:
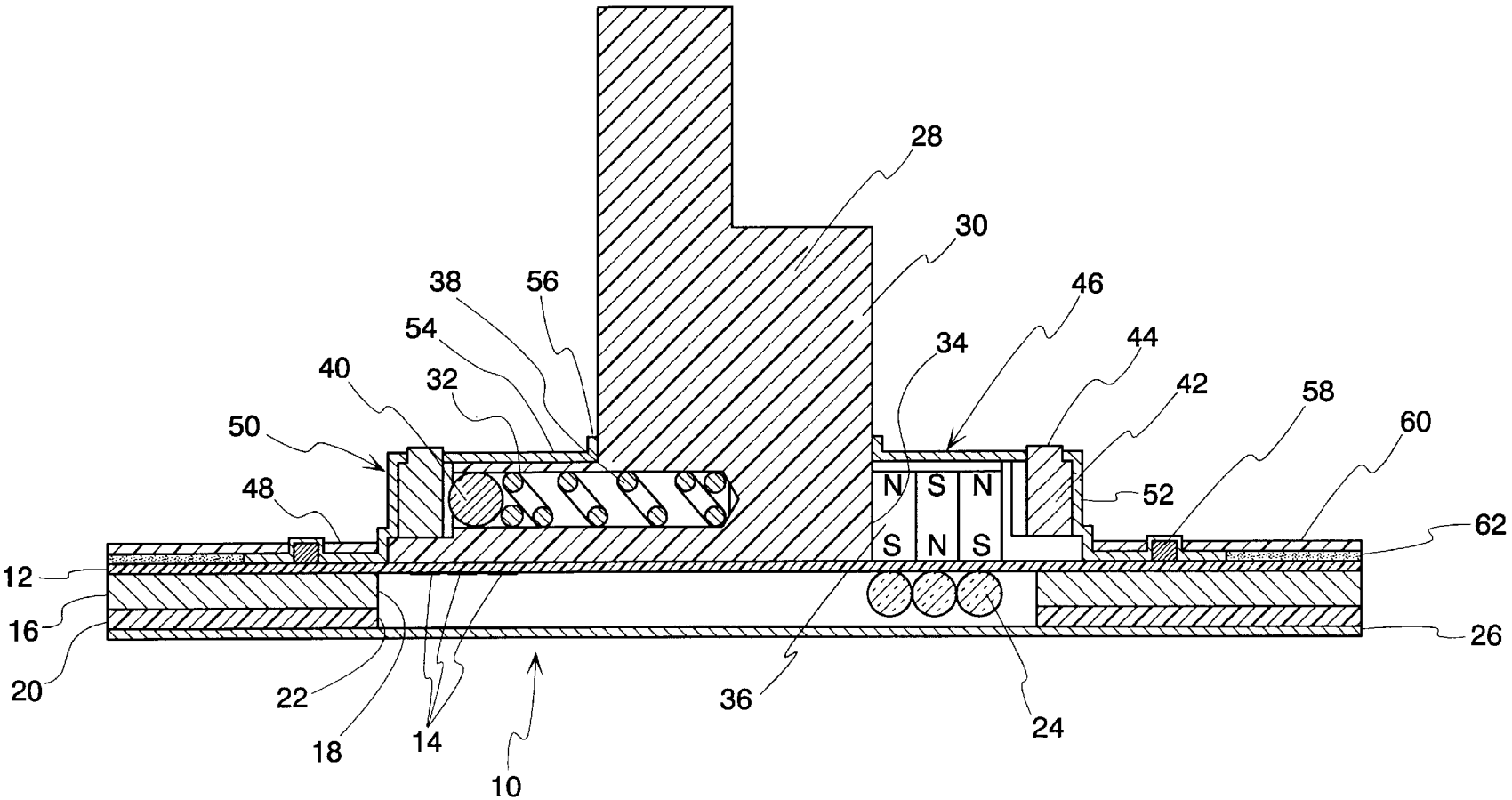
FIG. 1 is a section through a rotary switch having a knob retainer that releases from the carrier sheet, according to a first embodiment of the invention.

FIG. 1 illustrates a magnetically actuated switch 10 having a carrier sheet 12. In this case the carrier sheet is a polyester membrane having a first set of electrodes shown diagrammatically at 14 on its underside. A retainer magnet 16 is disposed adjacent the underside of the carrier sheet. The retainer magnet is a sheet or layer having an opening 18 in the area of the electrodes 14. It may be desirable to increase the thickness of the switch beneath the retainer magnet by adding a lower spacer 20 made of polyester or other suitable material. The lower spacer also has an opening 22 matching that of the retainer magnet. Together the openings provide sufficient space for the armature 24. Alternately, the retainer magnet layer could be made thick enough to accommodate the armature without the need of a lower spacer. The armature 24 is made of magnetic material which is also conductive. In this example the armature is a triple ball armature, although it could be a twin ball or disc armature. The bottom of the opening 22 is closed off by a containment member in the form of a bottom cover or substrate 26. The substrate is affixed to the lower spacer, either adhesively or magnetically, if the substrate is made of magnetic material. The containment member prevents loss of the armature from the space adjacent the electrodes.

Above the carrier sheet 12 is a knob 28. As used herein a knob is any structure manipulated by a user to actuate the electrical device, be it a switch, potentiometer or other configuration. The knob may be designed for rotary movement, linear movement or complex movement. Complex movement is either two-dimensional linear movement or some combination of linear movement and rotary movement. In the illustrated embodiment the knob is a rotor having a hub 30 and a flange 32. The flange has at least one receptacle 34 for receiving one or more coupler magnets 36. The coupler magnets attract the armature 24, holding it against the underside of the carrier sheet. As the knob moves the armature is compelled by the coupler magnets to move with the knob, thereby moving the armature relative to the electrodes on the underside of the carrier sheet.

The illustrated knob 28 includes an optional detent mechanism. A pocket formed in the flange and hub receives a detent spring 38 which urges a detent ball 40 radially outwardly. The ball engages spaced grooves on the inner surface of a detent ring 42. The detent ring has at least one stop pin 44 for holding it fixed relative to the knob, in a manner to be explained momentarily.

The knob 28 is rotatably mounted on the top side of the carrier sheet by a knob retainer 46. The knob retainer is made of magnetic material such as low carbon steel. As such the retainer will provide magnetic shielding to the exterior. The retainer 46 includes a base 48 and a catch 50. The base is releasably attached to the carrier sheet by the magnetic attraction exerted by the retainer magnet 16. The catch is connected to the base. The catch includes an axial portion 52 and a radial portion 54. The axial portion 52 extends sufficiently to accommodate the thickness of the knob's flange 32. The radial portion 54 extends sufficiently to capture the flange 32 underneath it. The radial portion may include a lip 56 to engage the hub loosely. The lip permits rotation of the knob while limiting lateral movement of the knob. The radial portion 54 also has openings therein which receive the stop pins 44 of the detent ring. This fixes the detent ring to the knob retainer.

The base 48 of the knob retainer may include one or more anti-rotation pins 58. These pins are received in apertures in an overlay 60 which may be a polyester sheet. The overlay may include suitable graphics. It is attached to the carrier sheet by an adhesive layer 62. The adhesive layer preferably is about the thickness of the base 48 so the overlay 60 lies flat on the base and adhesive. Both the adhesive layer 62 and overlay 60 have openings through which the knob retainer extends.

In an alternative construction the knob retainer can be made of molded plastic. In that case, the overlay and adhesive must be laminated to the carrier sheet to hold the retainer in place. It could have a flat on one side that would function as an anti-rotation device and provide a locating feature for locating the cover and the detent device relative to the underlying circuitry. The detent can also act as a stop. The outside surface of the knob retainer does not have to be round. The overlay can be embossed to accommodate a thicker base of the retainer. In any case, the switch is sealed to the front.

Figure 2:
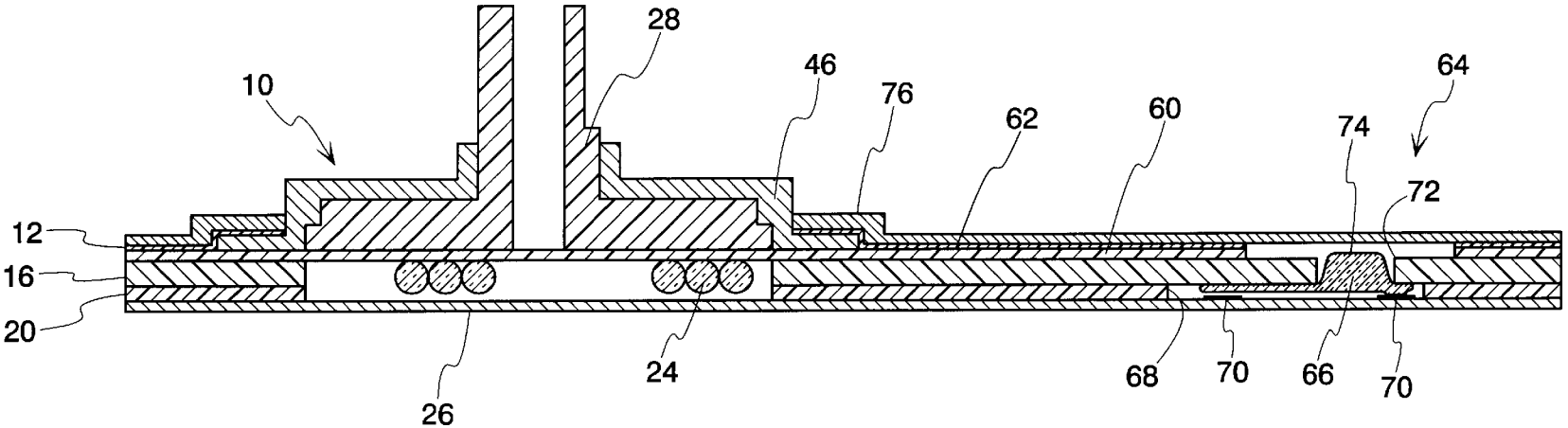
FIG. 2 is a section through a rotary switch having a releasable knob retainer and a pushbutton switch.

FIG. 2 illustrates an extension of the concept in FIG. 1. This switch has a rotary switch and knob similar to FIG. 1 and adds a pushbutton switch 64. The pushbutton switch shares the substrate 26, lower spacer 20, magnetic layer 16, carrier sheet 12, adhesive layer 62 and overlay 60 of the rotary switch. These parts are extended to accommodate an armature 66 in a second lower spacer opening 68. A second set of electrodes 70 is formed on the upper surface of the substrate in the area of the opening 68. The armature 66 is made of material affected by a magnet and is also electrically conductive. An opening 72 in the magnetic layer 16 receives an actuating button 74 of the armature. The overlay 60 is adhesively secured to the carrier sheet and may be embossed at 76 to engage the base of the retainer 46. The armature is pivotable between a normal position, in which it is spaced from electrodes 70 on the substrate, and a closed position, in which it shorts the electrodes. The armature is held in its normal position by the magnetic attraction between the magnet layer and the armature. When a user applies an actuating force to the armature, it suddenly snaps free of the magnet layer and closes against the electrodes, providing a switch closure and tactile feedback thereof. Removal of the actuating force allows the magnetic layer to retract the armature and re-open the switch. A fulcrum built into one end of the armature assists the pivoting motion of the armature.

Figure 3:
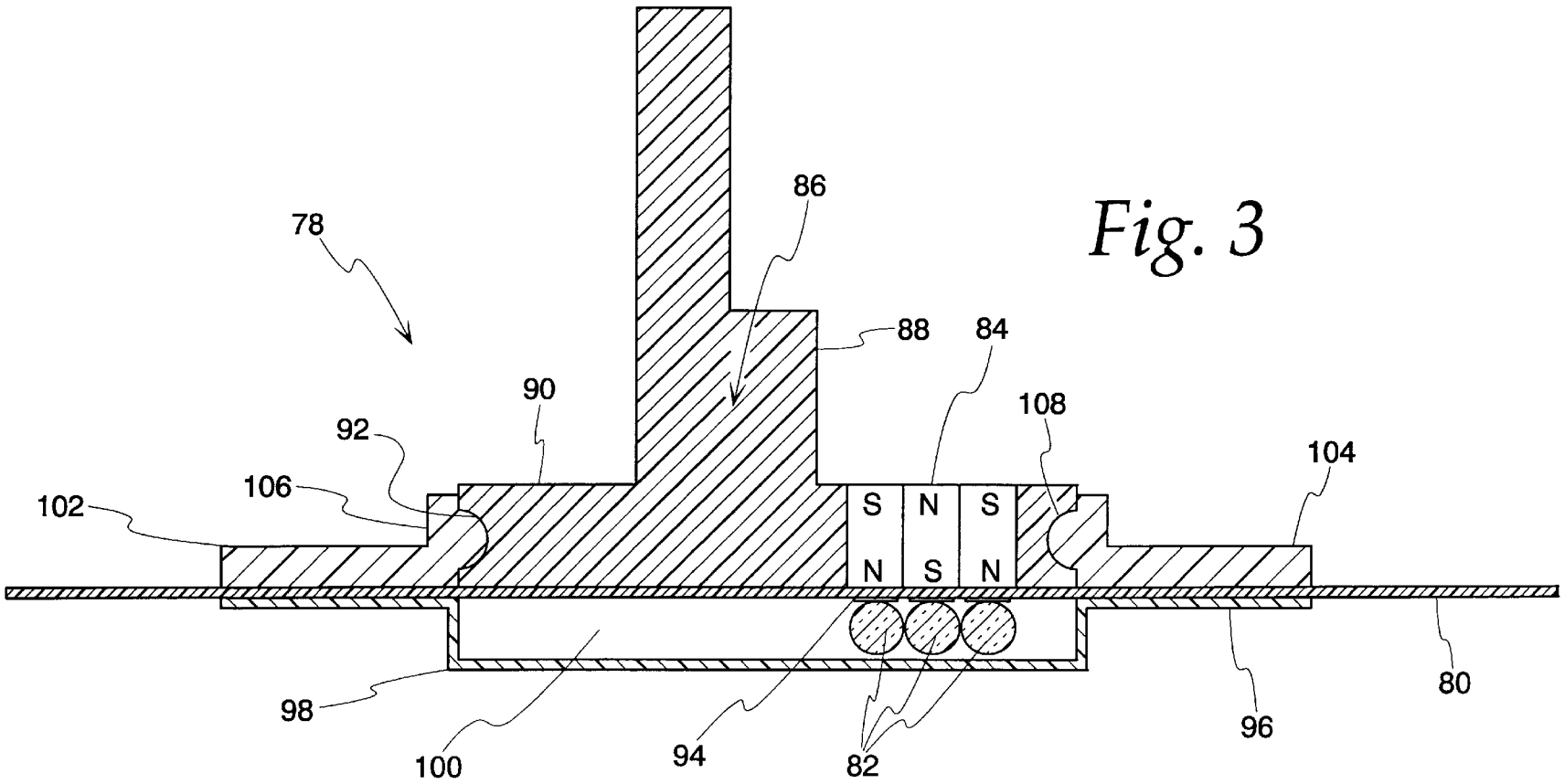
FIG. 3 is a section through a rotary switch having a knob retainer that releases the knob, according to an alternate embodiment of the invention.
Figure 4:
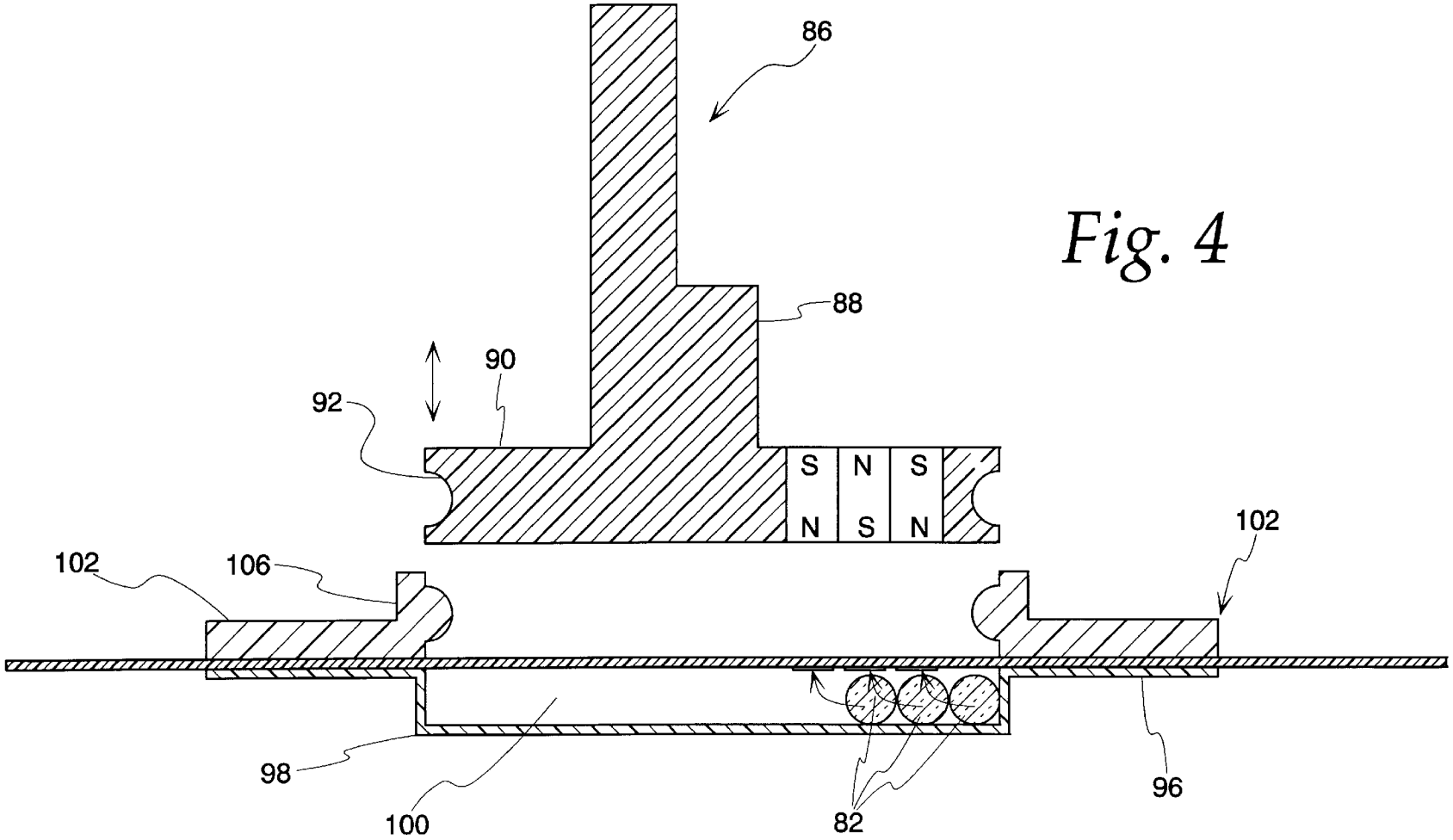
FIG. 4 is similar to FIG. 3, showing a released knob.

FIGS. 3 and 4 show an alternate arrangement of a knob retainer for a magnetically-actuated switch 78. The switch 78 of FIG. 3 is similar to the switch of FIG. 1, including a carrier sheet 80, a triple-ball armature 82, a coupler magnet 84, a knob 86 with a hub 88 and a flange 90. The flange has a groove 92 around its circumference. Once again the underside of the carrier 80 has a set of electrodes or contacts 94 which define the spaced contacts of at least one electrical switch or potentiometer. The armature 82 engages these electrodes, moving with the coupler magnet 84 as it turns with the knob 86. The armature is protected by a dome member, in this case a blister pack backer plate 96. Plate 96 is a film layer adhesively or otherwise secured to the underside of the carrier 80. Wherever a switch is located, a blister 98 is formed by embossing the film to provide a chamber 100 within which the armature 82 can float. Should the armature somehow become displaced, it is contained within the blister chamber 100 and thus the armature remains in the immediate vicinity of the magnets 84 located in the flange 90. The armature will be returned to its seated position either spontaneously after the dislodging force is removed, or when the rotor is again moved over the loose armature located inside the blister.

The retainer 102 has a base 104 adhesively or mechanically secured to the top of the carrier sheet 80. A flexible catch 106 is connected to the base 104. The catch includes a tab 108 that normally projects into the groove 92 of the knob 86 to retain the knob on the carrier sheet. The catch is sufficiently flexible to allow the tab to release the knob. The utility of removing the knob is two-fold. First, the knob can be designed to break away if it is inadvertently struck. In this case the operator merely replaces the rotor and rotates it for one revolution. The armature returns to its proper position as soon as the magnet 84 is passed directly over it. Second, removal of the knob can provide a security feature wherein the user removes the knob and renders the switch unactuatable until the knob is replaced.

Figure 5:
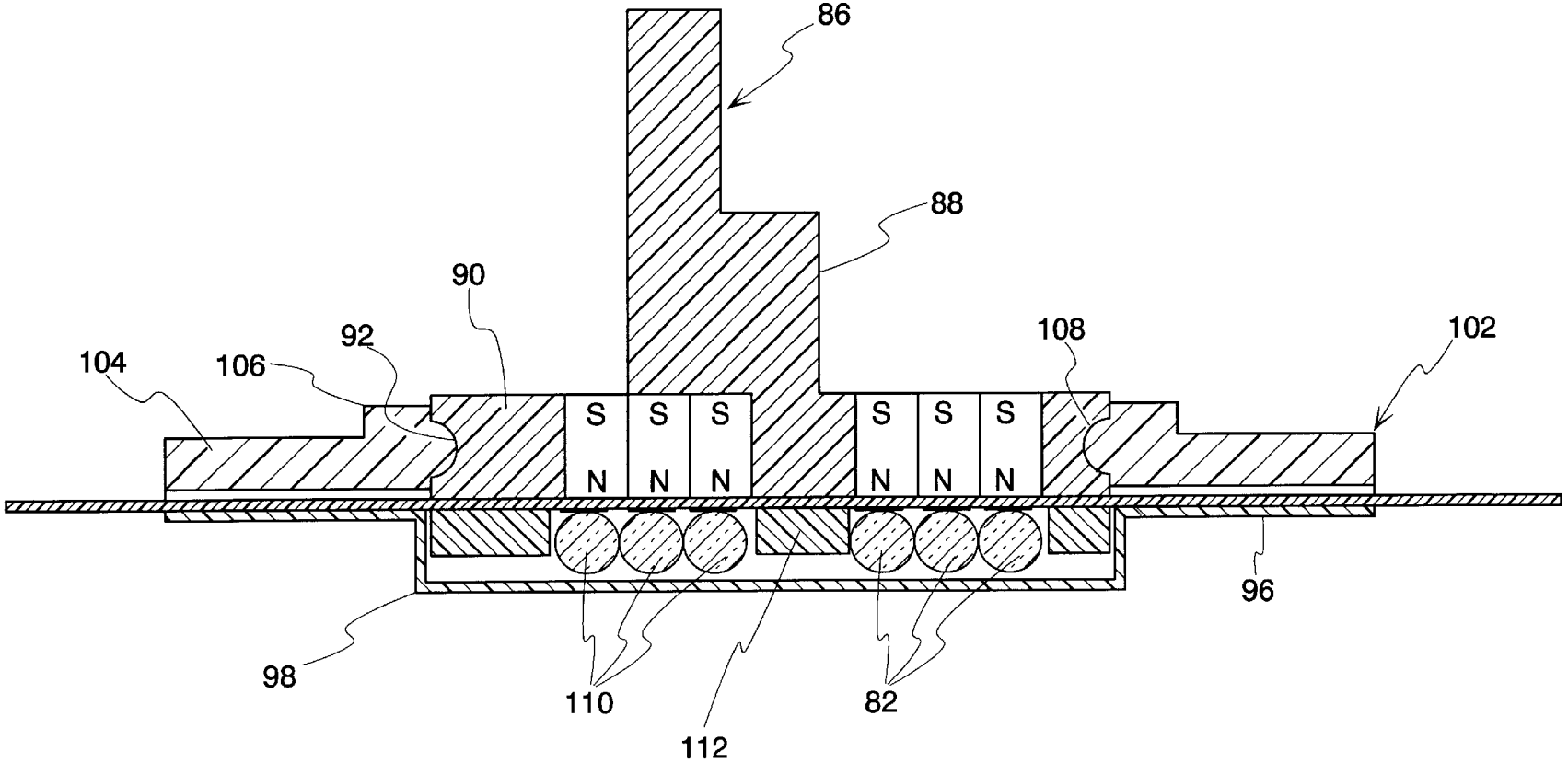
FIG. 5 is a variation of the switch of FIG. 3 showing a multiple armature arrangement.

FIG. 5 shows an alternate arrangement having multiple armatures. A second triple ball armature 110 is spaced from armature 82 by a separator 112. The separator ensures that the balls are returned to their appropriate groups when the knob is replaced.

Figure 6:
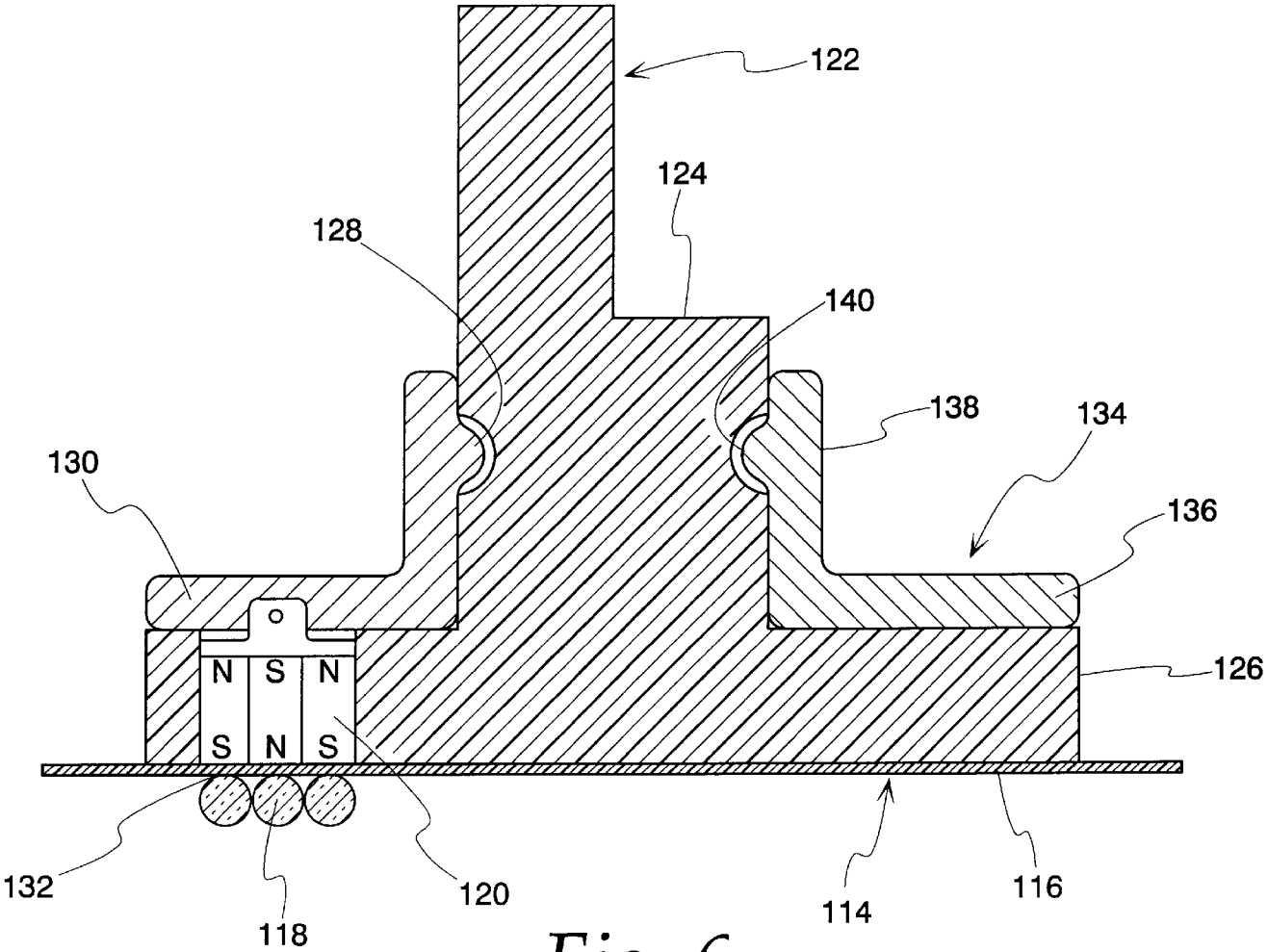
FIG. 6 is a section through a rotary switch having a magnet extractor.
Figure 7:
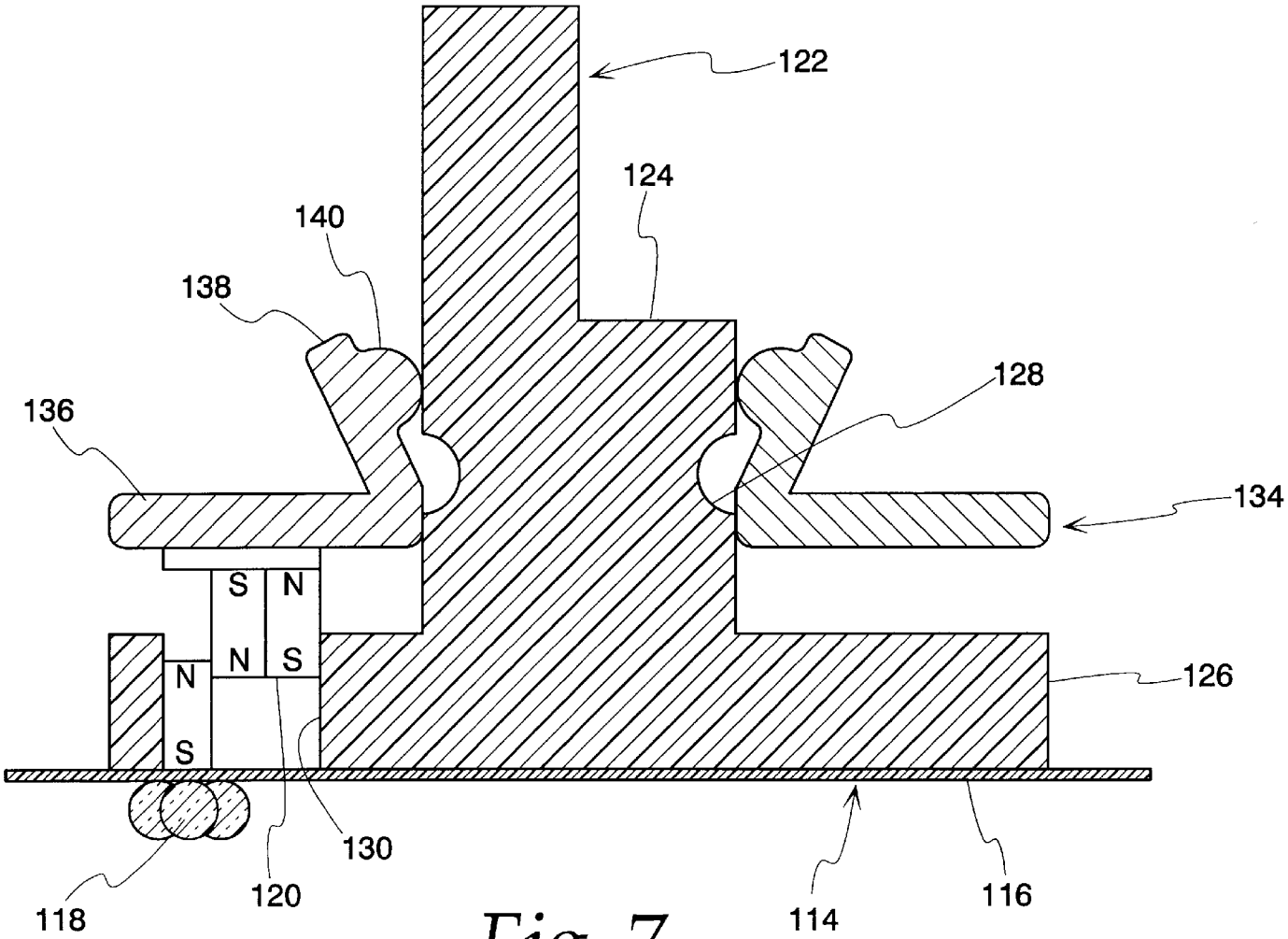
FIG. 7 is the switch of FIG. 6 with magnets partially extracted.

FIGS. 6 and 7 illustrate an arrangement which permits logical relocation of the knob. That is, the knob has multiple coupler magnet receptacles and a retractor that can move coupler magnets between receptacles. By relocating the coupler magnets the location of the armature will also be changed thereby altering the relationship between the armature and the set of electrodes. Thus, the response of the electrodes to knob motion is altered even though the physical relationship of the knob to the carrier is unchanged.

Switch 114 of FIGS. 6 and 7 is similar to the switch of FIG. 1. It includes a carrier sheet 116, a triple-ball armature 118, coupler magnets 120, a knob 122 with a hub 124 and a flange 126. The hub has a groove 128 around its circumference. The flange has at least two receptacles (one of which is shown at 130) for receiving the coupler magnets. The underside of the carrier 116 has a set of electrodes or contacts 132 which defined the spaced contacts of at least one electrical switch or potentiometer. The armature 118 engages these electrodes, moving with the coupler magnets 120 as it turns with the knob 122.

A magnet extractor 134 fits around the hub 124 of the knob. The extractor includes a leg 136 that rests on or near the upper surface of the flange 126. The leg is made from magnetic material. An arm 138 extends upwardly from the leg and has a tab 140 that engages the groove 128 in the hub. The arm 138 can be flexed to the position of FIG. 7 to withdraw the tab 140 from groove 128. This permits the extractor to be raised from the flange 126, carrying the coupler magnets 120 with it. From the position of FIG. 7, the extractor 134 can be rotated to align the coupler magnets 120 with a different receptacle. The extractor is then lowered to place the magnets in the new receptacle. As mentioned above this alters the logical relationship between the armature and electrodes without altering the position of the knob with respect to the carrier. This construction can be used in applications such as the main control on a washing machine where the operator would like to disengage the rotor and rotate it to a different position before re-engaging it.

While a preferred form of the invention has been shown and described, it will be realized that alterations and modifications may be made thereto without departing from the scope of the following claims.

I claim:

1. In a magnetically actuated switch of the type having a carrier sheet, electrodes formed on one side of the carrier sheet, an armature made of magnetic material disposed on said one side of the carrier sheet, a movable knob mounted on the other side of the carrier sheet, and at least one magnet affixed to the knob and movable therewith for actuating the armature, the improvement comprising a knob retainer, comprising:

a base engageable with said other side of the carrier sheet and a catch attached to the base, the catch being engageable with the knob to retain the knob adjacent the carrier sheet, one of the base or catch being releasably attached to the carrier sheet or knob.

2. The switch of claim 1 further comprising a retainer magnet on said one side of the carrier sheet, positioned to releasably attach the base to the other side of the carrier sheet.

3. The switch of claim 2 further comprising:

a spacer layer adjacent to the retainer magnet and having an opening therein;

a substrate adjacent to the spacer layer;

a set of electrodes disposed on said substrate and defining at least one pair of spaced switch contacts;

an electrically conductive armature disposed in said opening and between the retainer magnet and the switch contacts, the armature being made of magnetic material such that the armature is normally held spaced from the switch contacts in engagement with said retainer magnet by the magnetic attraction between the retainer magnet and armature; and an aperture in the retainer magnet, with the armature being disposed with respect to the aperture such that an actuating force exerted through the aperture will cause the armature to release from the retainer magnet and contact the switch contacts on the substrate.

4. The switch of claim 1 wherein the base is adhesively attached to said other side of the carrier sheet and the catch is pivotably connected to the base.

5. The switch of claim 4 wherein the knob includes a groove and the catch includes a tab engageable with the groove.

6. A magnetically actuated switch comprising a carrier sheet, electrodes formed on one side of the carrier sheet, an armature made of magnetic material disposed on said one side of the carrier sheet, a movable knob mounted on the other side of the carrier sheet and having a plurality of magnet-receiving receptacles therein, at least one magnet mounted in one of said receptacles in the knob and movable therewith for actuating the armature, and a magnet extractor made of magnetic material, the extractor being movable with respect to the knob to withdraw the magnets from one receptacle and deposit them in another receptacle.

7. The switch of claim 6 wherein the knob has a central hub connected to a flange with a groove in the hub and said receptacles formed in the flange, the magnet extractor having a ring disposed above said flange with flexible tabs attached to the ring and normally engaged in the groove, the tabs being releasable from the groove to allow the extractor to move both axially and rotationally with respect to the hub.

* * * * *